US008684198B2

(12) United States Patent
Irieda et al.

(10) Patent No.: US 8,684,198 B2
(45) Date of Patent: Apr. 1, 2014

(54) WORKING MACHINE

(75) Inventors: Katsuya Irieda, Hiroshima (JP); Takanori Yamasaki, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 549 days.

(21) Appl. No.: 13/009,194

(22) Filed: Jan. 19, 2011

(65) Prior Publication Data

US 2011/0188982 A1 Aug. 4, 2011

(30) Foreign Application Priority Data

Feb. 1, 2010 (JP) ..... 2010-020145

(51) Int. Cl.
*B66C 23/68* (2006.01)

(52) U.S. Cl.
USPC ..... 212/299; 212/295; 212/298

(58) Field of Classification Search
USPC ..... 212/295, 297–300, 264
See application file for complete search history.

(56) References Cited

U.S. PATENT DOCUMENTS 3,557,967 A * 1/1971 Madole ..... 414/549
3,664,516 A * 5/1972 Goudy ..... 212/297
3,726,421 A * 4/1973 Goldhofer ..... 414/547
3,917,088 A * 11/1975 Visser ..... 414/680
4,094,422 A * 6/1978 Thompson ..... 414/715
4,193,734 A * 3/1980 Williams ..... 414/694
4,265,063 A * 5/1981 Muller ..... 52/115
4,304,077 A * 12/1981 Muller ..... 52/115
4,461,369 A * 7/1984 Amador ..... 182/2.9
5,501,346 A * 3/1996 Wimmer ..... 212/349

(Continued)

FOREIGN PATENT DOCUMENTS

CN 2868584 Y 2/2007
CN 101413246 A 4/2009

(Continued)

OTHER PUBLICATIONS

Combined Chinese Office Action and Search Report issued Nov. 12, 2012 in Chinese Patent Application No. 201110037109.9 (with partial English-language translation and English translation of category of cited documents).

(Continued)

*Primary Examiner* — Emmanuel M Marcelo
*Assistant Examiner* — Michael Gallion
(74) *Attorney, Agent, or Firm* — Oblon, Spivak, McClelland, Maier & Neustadt, L.L.P.

(57) ABSTRACT

A working machine includes a base machine and a working attachment. The working attachment has a base-end boom, a lead-end boom, and an arm. The working machine is collapsible into a triple-folded state, with the base-end boom being located on the upper side and the arm being located on the lower side with respect to the lead-end boom, as a posture of the working machine for transport. The working machine further includes a lead-end boom cylinder for moving the lead-end boom, and an arm cylinder for moving the arm. The lead-end boom has a first lead-end boom cylinder attachment portion for mounting the lead-end boom cylinder, and a first arm cylinder attachment portion for mounting the arm cylinder. The first lead-end boom cylinder attachment portion is disposed at a position different from the first arm cylinder attachment portion in a widthwise direction of the working attachment, and lower than the first arm cylinder attachment portion in the transport posture.

9 Claims, 12 Drawing Sheets

(56) References Cited

U.S. PATENT DOCUMENTS

| | | | | | |
|---|---|---|---|---|---|
| 5,806,313 | A | * | 9/1998 | Koshi et al. | 60/458 |
| 6,129,226 | A | * | 10/2000 | Donovan | 212/300 |
| 6,250,485 | B1 | * | 6/2001 | Olson | 212/260 |
| 6,260,720 | B1 | * | 7/2001 | Gunnarsson et al. | 212/300 |
| 7,070,383 | B2 | * | 7/2006 | Sugimoto | 414/694 |

FOREIGN PATENT DOCUMENTS

| | | | | | |
|---|---|---|---|---|---|
| JP | 5-96153 | | 12/1993 | | |
| JP | 11-193543 | A | | 7/1999 | |
| JP | 11193543 | A | * | 7/1999 | E02F 3/38 |
| JP | 2005-105520 | A | | 4/2005 | |
| JP | 2007-203221 | | | 8/2007 | |
| JP | 2007-205067 | | | 8/2007 | |
| JP | A-2009/209549 | | | 9/2009 | |

OTHER PUBLICATIONS

Search Report issued Apr. 27, 2011, in European Application No. EP 11 15 2175.

* cited by examiner

WORKING MACHINE

BACKGROUND OF THE INVENTION

1. Field of the Invention

The present invention relates to a working machine, such as a demolition machine, equipped with a base machine and a working attachment to be attached to the base machine.

2. Description of the Background Art

There has been known a demolition machine equipped with an ultra-long attachment for use in demolishing e.g. high-rise buildings.

As shown in FIG. 11, the demolition machine is provided with a base machine 3, and a working attachment 4 to be attached to a front part of the base machine 3. The base machine 3 is provided with a crawler-type lower traveling body 1, and an upper rotating body 2 mounted on the lower traveling body 1 to turn around a vertical axis.

The working attachment 4 includes a base-end boom (hereinafter, simply called as a boom) 5 which is mounted on the base machine 3 (upper rotating body 2) to move up and down, a short-sized lead-end boom (hereinafter, called as an internal boom) 6 which is mounted on a lead end of the boom 5 to be pivotally movable about a horizontal axis for the purpose of expanding a working range, an arm 7 which is mounted on a lead end of the internal boom 6 to be pivotally movable about a horizontal axis, and a working device 8 (corresponding to a crusher called a nibbler in the example shown in FIG. 11) which is mounted on a lead end of the arm 7.

The boom 5 includes a main boom 5*a* which is provided on the lower side, and a front boom 5*b* which is provided on the upper side and which is detachably attached to the main boom 5*a*. The demolition machine is disassembled into a portion including the base machine 3 and the main boom 5*a*, and a portion of the working attachment 4 excluding the main boom 5*a* at the time of transport.

The front boom 5*b* generally has multi-stage boom members which are detachably attachable to each other. However, FIG. 11 shows the front boom 5*b* comprised of a single boom member to simplify the illustration.

Further, the demolition machine has plural cylinders (hydraulic cylinders) for moving the working attachment 4. Specifically, the demolition machine is provided with a boom cylinder 9 for moving the boom 5 (entirety of the working attachment 4) up and down, an internal boom cylinder 10 for moving the internal boom 6, an arm cylinder 11 for moving the arm 7, and a working device cylinder 12 for moving the working device 8.

The internal boom cylinder 10 is disposed between the boom 5 (front boom 5*b*) and the internal boom 6 at an inner position of the working attachment 4 when the working attachment 4 is folded. Similarly, the arm cylinder 11 is disposed between the internal boom 6 and the arm 7 at an inner position of the working attachment 4 when the working attachment 4 is folded.

The above arrangement is disclosed in Japanese Unexamined Patent Publication No. 2007-203221.

In the case where the demolition machine equipped with the ultra-long attachment having the above arrangement is disassembled, as shown by the solid line in FIG. 11, the working attachment 4 is placed on the ground in a triple-folded state, with the boom 5 being located on the upper side, and the arm 7 being located on the lower side with respect to the internal boom 6. In this state, the demolition machine is disassembled into the portion including the base machine 3 and the main boom 5*a*, and the portion of the working attachment 4 excluding the main boom 5*a* for transport, as described above.

Further, similarly to the disassembling operation as described above, assembling of the demolition machine after the transport is performed in a state that the portion of the triple-folded working attachment 4 (portion excluding the main boom 5*a*) is placed on the ground, with the boom 5 being located on the upper side, and the arm 7 being located on the lower side with respect to the internal boom 6.

In the demolition machine having the above arrangement, since the internal boom cylinder 10 and the arm cylinder 11 are disposed on the same position in the width direction of the working attachment 4, when the working attachment 4 is viewed from above in the folded posture indicated by the solid line in FIG. 11, it is necessary to secure a certain space between the cylinders 10 and 11 to keep the cylinders 10 and 11 from contacting with each other.

As a result, the heightwise space for the cylinders 10 and 11 is increased.

As shown in FIG. 12, attachment points of the boom 5 and the arm 7 with respect to the internal boom 6 are respectively indicated by the reference numerals X1 and X2, and attachment points (points of application of cylinder thrust force) of the internal boom cylinder 10 and the arm cylinder 11 with respect to the internal boom 6 are respectively indicated by the reference numerals Y1 and Y2. In this case, since the forces for moving the internal boom 6 and the arm 7 are proportional to the distance $\alpha 1$ (hereinafter, called as the moment length $\alpha 1$) between X1 and Y1, and the distance $\alpha 2$ (hereinafter, called as the moment length $\alpha 2$) between X2 and Y2, predetermined moment lengths $\alpha 1$ and $\alpha 2$ are required to secure intended application forces.

Consequently, since the distance (required length for the internal boom 6) between the boom 5 and the arm 7 in a folded posture is increased, the height (lead-end height H1 and overall height H2) of the working attachment 4 relative to the ground is increased.

Thus, in the demolition machine shown in FIGS. 11 and 12, disassembling and assembling operations are performed at a high position, and it is difficult or impossible to sufficiently secure enhanced safety and operability.

Further, since the overall height of the working attachment 4 at the time of transport is increased, it is impossible to transport the working attachment 4 by a truck even if the working attachment 4 meets the weight regulations, and it is necessary to transport the working attachment 4 by a low-floor trailer. Thus, the transport cost of the demolition machine is increased.

SUMMARY OF THE INVENTION

An object of the invention is to provide a working machine that enables to reduce the height of a working attachment at the time of transport by shortening the distance (required length for a lead-end boom) between a base-end boom and an arm when the working attachment is set in a folded posture, while securing a required moment length.

A working machine according to an aspect of the invention includes a base machine; a working attachment; at least one lead-end boom cylinder which is disposed between the base-end boom and the lead-end boom at an attachment inner position corresponding to an inner side of the working attachment in the transport posture, and which is operable to pivotally move the lead-end boom with respect to the base-end boom; and at least one arm cylinder which is disposed between the lead-end boom and the arm at the attachment inner position, and which is operable to move the arm with respect to the lead-end boom. The working attachment includes a base-end boom which is mounted on the base machine to be movable up and down, a lead-end boom which is mounted on a lead end of the base-end boom to be pivotally movable about a horizontal axis, an arm which is mounted on a lead end of the lead-end boom to be pivotally movable about a horizontal axis, and a working device which is mounted on a lead end of the arm. The working attachment is collapsible into a triple-folded state, with the base-end boom being located on the upper side and the arm being located on the lower side with respect to the lead-end boom, as a posture of the working machine for transport. The lead-end boom includes at least one first lead-end boom cylinder attachment portion for mounting the lead-end boom cylinder, and at least one first arm cylinder attachment portion for mounting the arm cylinder. The first lead-end boom cylinder attachment portion is disposed at a position different from the first arm cylinder attachment portion in a widthwise direction of the working attachment, and lower than the first arm cylinder attachment portion in the transport posture.

These and other objects, features and advantages of the present invention will become more apparent upon reading the following detailed description along with the accompanying drawings.

DETAILED DESCRIPTION OF THE PREFERRED EMBODIMENTS OF THE INVENTION

Figure 1:
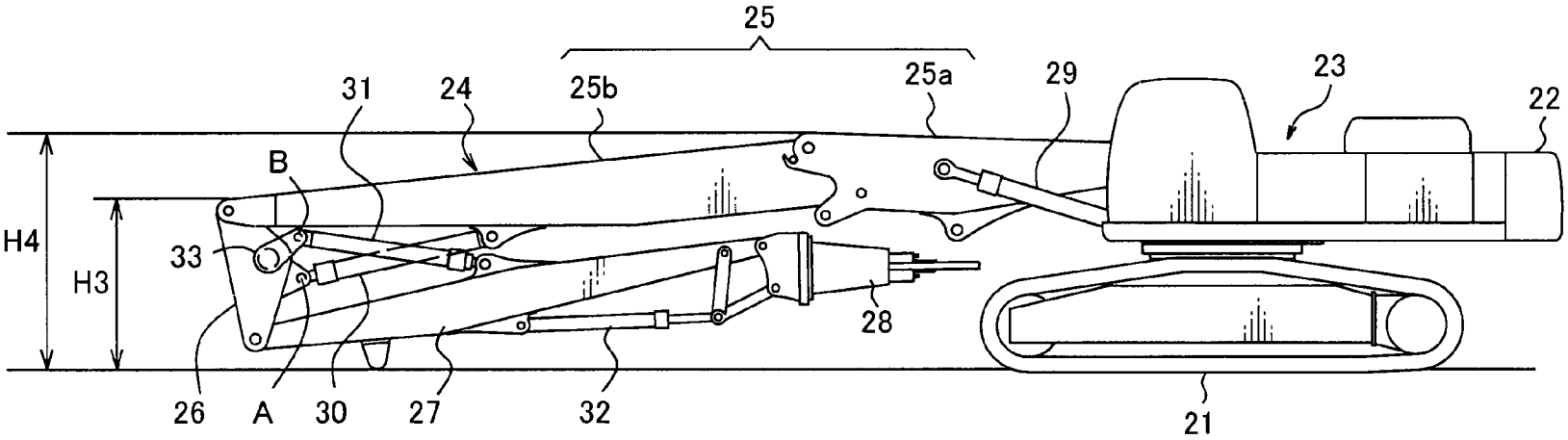
FIG. 1 is a schematically side view showing a folded state of a demolition machine equipped with an ultra-long attachment according to the first embodiment of the invention.

In the following, embodiments of the invention are described referring to the drawings. The following embodiments are merely examples embodying the invention, and do not limit the technical scope of the invention.

Figure 2:
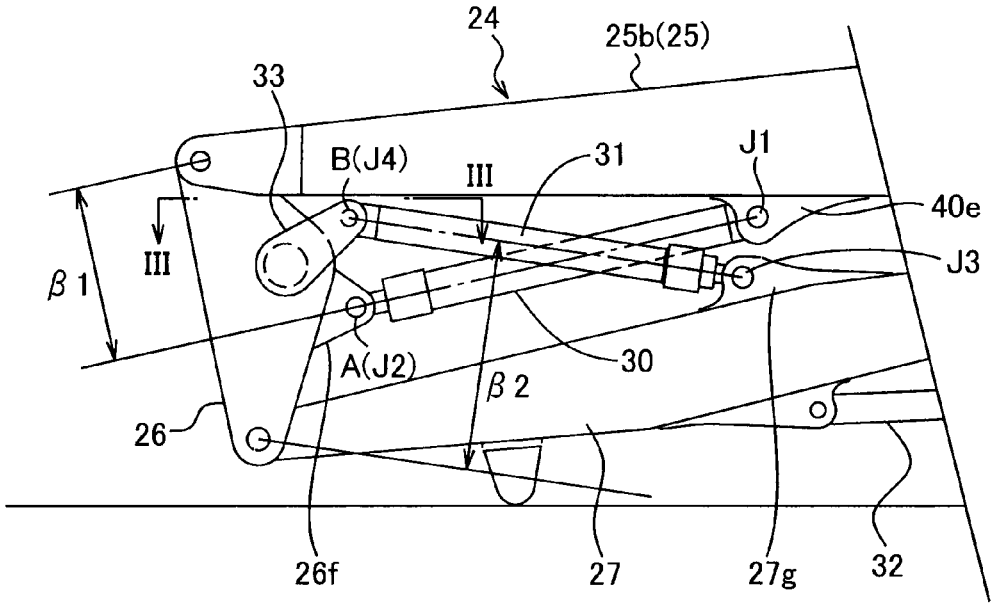
FIG. 2 is a partially enlarged view of FIG. 1.
Figure 3:
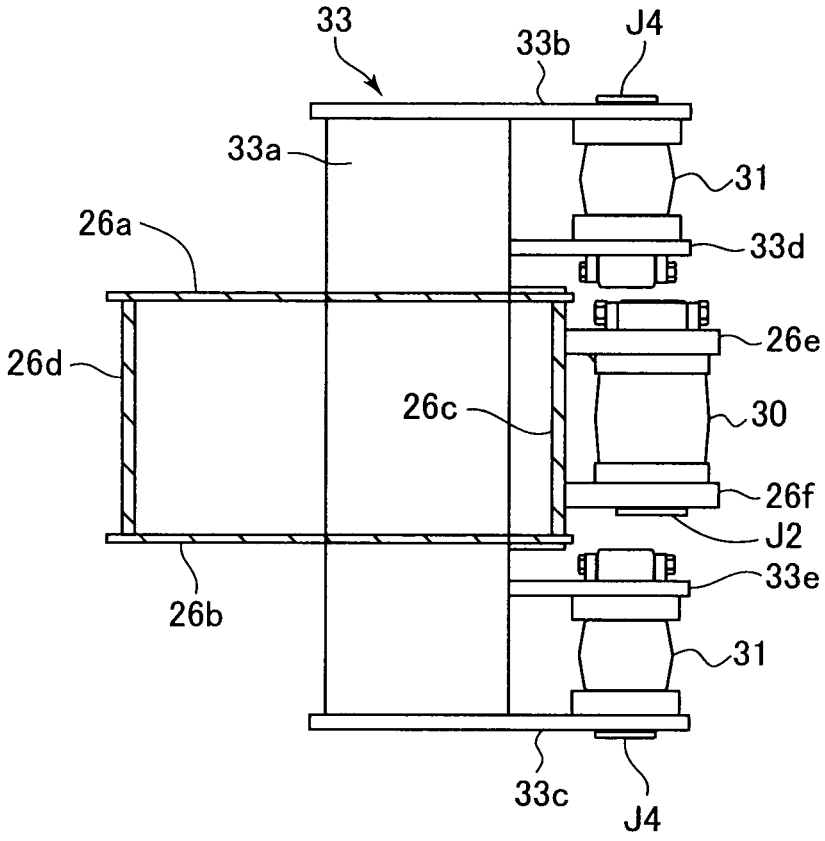
FIG. 3 is an enlarged sectional view taken along the line III-III in FIG. 2.

First Embodiment (See FIGS. 1 through 3)

A demolition machine equipped with an ultra-long attachment according to the first embodiment is provided with a base machine 23, and a working attachment 24 to be attached on the base machine 23.

The base machine 23 includes a crawler-type lower traveling body 21, and an upper rotating body 22 mounted on the lower traveling body 21 to rotate around a vertical axis. The working attachment 24 is attached to a front part of the base machine 23.

The working attachment 24 includes a boom (base-end boom) 25 which is mounted on the base machine 23 (upper rotating body 22) to be movable up and down, a short internal boom (lead-end boom) 26 which is mounted on a lead end of the boom 25 to be pivotally movable about a horizontal axis, an arm 27 which is mounted on a lead end of the internal boom 26 to be pivotally movable about a horizontal axis, and a working device 28 which is mounted on a lead end of the arm 27. Further, as shown in FIGS. 1 and 2, the working attachment 24 is collapsible into a triple-folded state, with the boom 25 being located on the upper side, and the arm 27 being located on the lower side with respect to the internal boom 26, as a posture of the demolition machine for transport.

The demolition machine further includes, as cylinders for moving the working attachment 24, a boom cylinder 29 for moving the boom 25 (entirety of the working attachment 24) up and down, an internal boom cylinder (lead-end boom cylinder) 30 for moving the internal boom 26, a pair of arm cylinders 31, 31 for moving the arm 27, and a working device cylinder 32 for moving the working device 28. The internal boom cylinder 30 is disposed between the boom 25 and the internal boom 26 at an attachment inner position corresponding to the inner side of the working attachment 24 in the above transport posture. Further, the arm cylinders 31, 31 are disposed between the internal boom 26 and the arm 27 at the attachment inner position.

The boom 25 includes a main boom 25*a* which is mounted on the base machine 23 to be movable up and down, and a front boom 25*b* which is detachably attached to a lead end of the main boom 25*a*. The front boom 25*b* has a second internal boom cylinder attachment portion (second lead-end boom cylinder attachment portion) 40*e* for rotatably supporting a head-side end portion of the internal boom cylinder 30 about a horizontal axis J1. The second internal boom cylinder attachment portion 40*e* is disposed at a middle position of the front boom 25*b* in the width direction of the working attachment 24, and on an inner side surface of the front boom 25 corresponding to the inner side of the working attachment 24 in the transport posture.

As shown in FIG. 3, the internal boom 26 includes a body portion comprised of a right side plate 26*a*, a left side plate 26*b*, a bottom plate 26*c*, and a top plate 26*d*, brackets (first lead-end boom cylinder attachment portion) 26*e*, 26*f* for mounting the internal boom cylinder 30, and a first arm cylinder attachment portion 33 for mounting the arm cylinders 31, 31.

The brackets 26*e*, 26*f* rotatably support a rod-side end portion of the internal boom cylinder 30 disposed between the brackets 26*e*, 26*f* about a horizontal axis J2. Specifically, the brackets 26*e*, 26*f* extend from the bottom plate 26*c* toward the attachment inner position, at the middle position in the width direction of the working attachment 24.

The first arm cylinder attachment portion 33 supports the arm cylinders 31, 31 at a different position from the internal boom cylinder 30 in the width direction of the working attachment 24. Specifically, the first arm cylinder attachment portion 33 includes a tubular member 33*a* which passes through the side plates 26*a*, 26*b* and transversely extends from the side plates 26*a*, 26*b*; brackets 33*b*, 33*c* respectively fixed to both end surfaces of the tubular member 33*a*; a bracket 33*d* disposed between the side plate 26*a* and the bracket 33*b*; and a bracket 33*e* disposed between the side plate 26*b* and the bracket 33*c*. The brackets 33*b* through 33*e* respectively extend from the tubular member 33*a* toward the attachment inner position (rearwardly), at a slightly upper position with respect to the intermediate position in the height direction of the internal boom 26 in the transport posture. The brackets 33*b*, 33*d* rotatably support a head-side end portion of the arm cylinder 31 disposed between the brackets 33*b*, 33*d* about a horizontal axis J4. The brackets 33*c*, 33*e* rotatably support a head-side end portion of the arm cylinder 31 disposed between the brackets 33*c*, 33*e* about another horizontal axis J4.

As described above, the brackets 26*e*, 26*f*, the brackets 33*b*, 33*d*, and the brackets 33*c*, 33*e* are disposed at different positions from each other in the width direction of the working attachment 24. Specifically, the brackets 26*e*, 26*f* are disposed at the middle position in the width direction of the working attachment 24; and the brackets 33*b*, 33*d*, and the brackets 33*c*, 33*e* are disposed on both sides of the brackets 26*e*, 26*f* in the width direction of the working attachment 24, with the brackets 26*e*, 26*f* being interposed between the brackets 33*b*, 33*d*, and the brackets 33*c*, 33*e*.

The arm 27 has a pair of second arm cylinder attachment portions 27*g*, 27*g* for rotatably supporting the rod-side end portions of the arm cylinders 31, 31 about a horizontal axis J3, respectively. One of the paired second arm cylinder attachment portions 27*g*, 27*g* is disposed at the same position as the brackets 33*b*, 33*d* in the width direction of the working attachment 24, and the other one of the paired second arm cylinder attachment portions 27*g*, 27*g* is disposed at the same position as the brackets 33*c*, 33*e* in the width direction of the working attachment 24.

The demolition machine is disassembled into a portion including the base machine 3 and the main boom 25*a*, and a portion of the working attachment 24 excluding the main boom 25*a* when the working attachment 24 in the transport posture is placed on the ground. An assembling operation after the disassembling and transport is performed in a state that the portion (portion of the working attachment 24 excluding the main boom 25*a*) of the working attachment 24 in the transport posture is placed on the ground.

In this example, in the case where the attachment points of the internal boom cylinder 30, and the arm cylinders 31, 31 with respect to the internal boom 26 are defined as A and B, the attachment point A is located on the lower side, and the attachment point B is located on the upper side, and the attachment points A and B are displaced from each other in the width direction of the internal boom 26 in the transport posture.

More specifically, the single internal boom cylinder 30 is mounted between the boom 25 (front boom 25*b*), and an intermediate portion (attachment point A) in the height direction of the internal boom 26, at a middle portion in the width direction of the boom 25 and the internal boom 26.

The two arm cylinders 31, 31 are disposed at both sides of the internal boom cylinder 30 in the width direction of the internal boom 26 and the arm 27, with the internal boom cylinder 30 being interposed between the two arm cylinders 31, 31. One ends (rod-side end portions) of the respective arm cylinders 31, 31 are attached to the arm 27. The other ends (head-side end portions) of the respective arm cylinders 31, 31 are attached to the internal boom 26 at a position (attachment point B), which is higher than the attachment point A of the internal boom cylinder 30 via the first arm cylinder attachment portion 33.

With the demolition machine of this embodiment, both of the internal boom cylinder 30, and the arm cylinders 31, 31 are disposed at different positions from each other in the width direction of the working attachment 24, and the internal boom cylinder 30 and the arm cylinders 31, 31 intersect with each other in an X-shape in side view.

Figure 11:
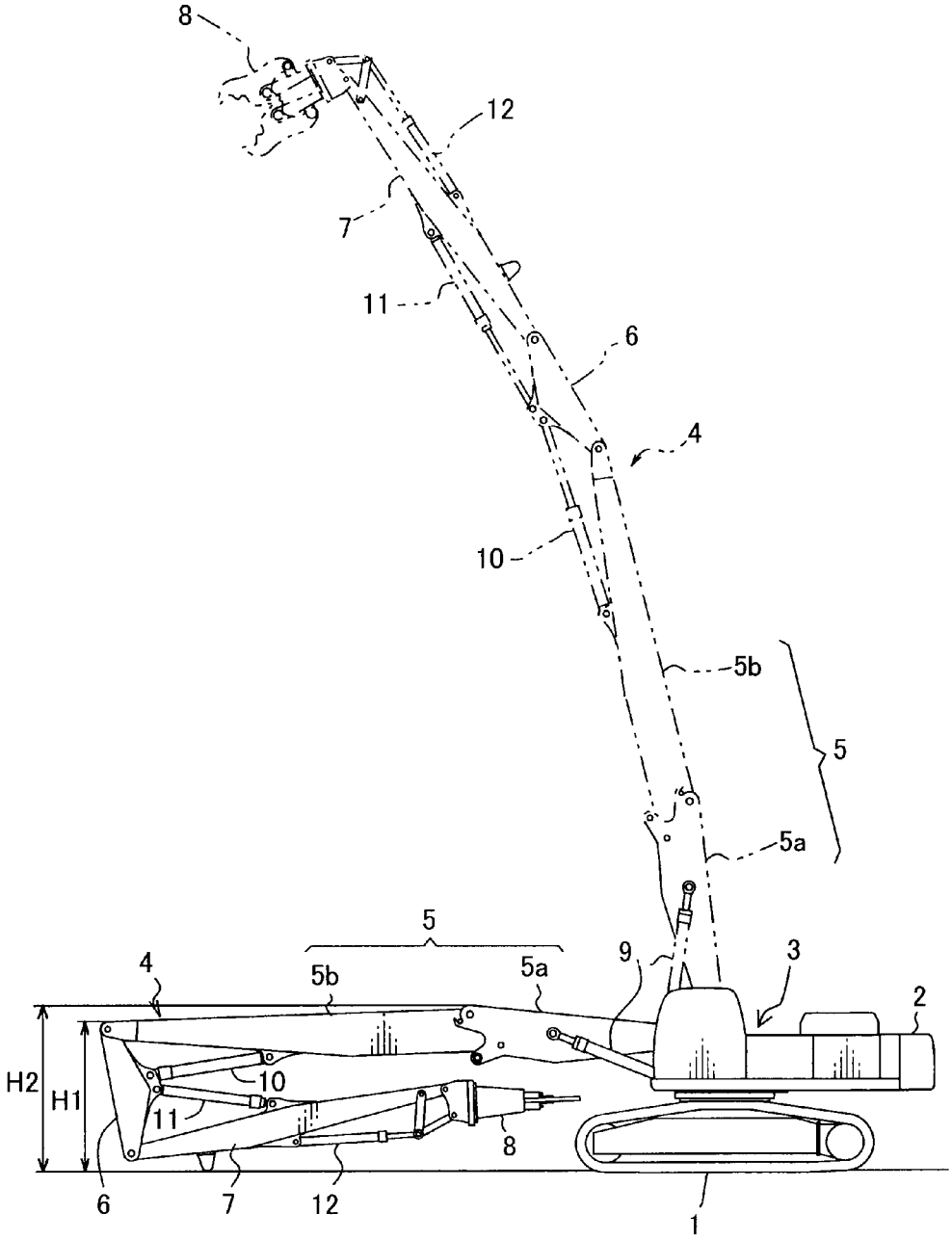
PRIOR ART FIG.11
FIG. 11 is a schematic side view showing a conventional demolition machine.
Figure 12:
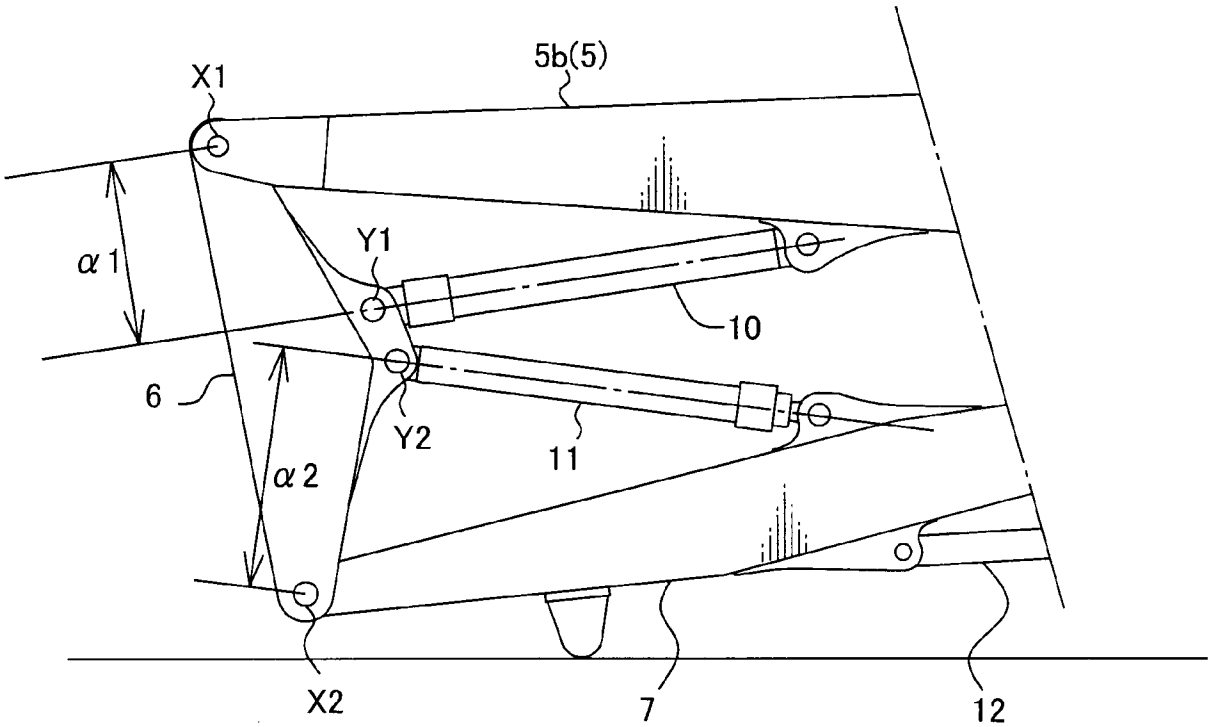
PRIOR ART FIG.12
FIG. 12 is a partially enlarged view of FIG. 11.

With the above arrangement, as compared with the conventional art as shown in FIGS. 11 and 12, wherein both of the cylinders 10 and 11 are disposed at the same position in the width direction of the working attachment 4 and vertically away from each other, it is possible to reduce the heightwise space for both of the internal boom cylinder 30, and the arm cylinders 31, 31, while securing required moment lengths $\beta 1$ and $\beta 2$ (which are equal to or longer than the moment lengths $\alpha 1$ and $\alpha 2$ in the conventional art).

Since the distance (required length for the internal boom 26) between the boom 25 and the arm 27 in the transport posture can be shortened, it is possible to reduce the attachment height (lead-end height H3 and overall height H4), and enhance safety and operability at the time of disassembling/assembling operation.

Further, since the overall height H4 at the time of transport can be reduced, it is possible to transport the working machine by a truck, which was impossible in the conventional art, as far as the weight requirement is satisfied. This enables to realize cost reduction. Furthermore, since the centroid of the working attachment 24 (demolition machine) is lowered, stability at the time of transport can be enhanced.

Figure 4:
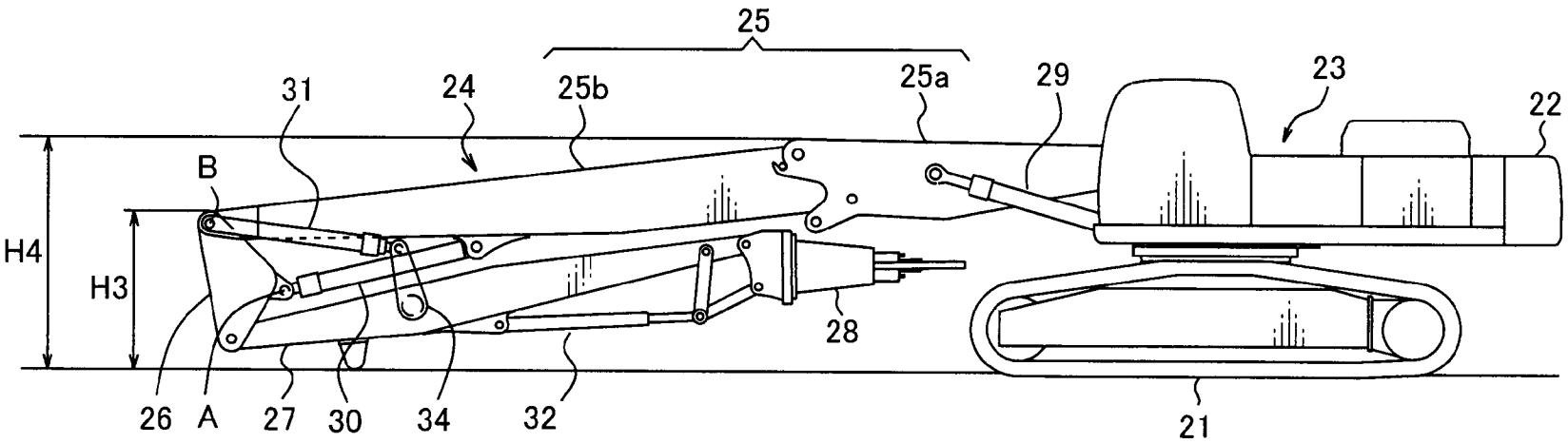
FIG. 4 is a diagram corresponding to FIG. 1 and showing the second embodiment of the invention.
Figure 5:
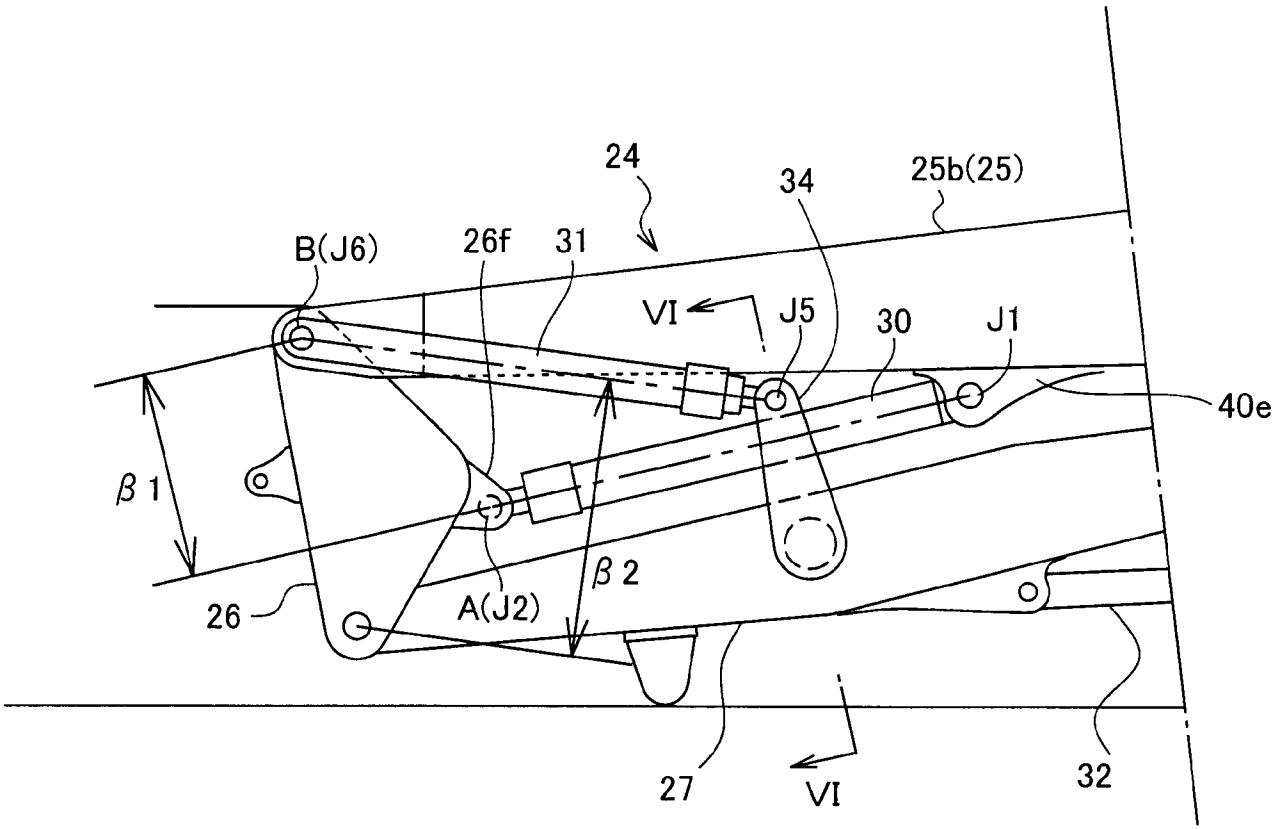
FIG. 5 is a partially enlarged view of FIG. 4.
Figure 6:
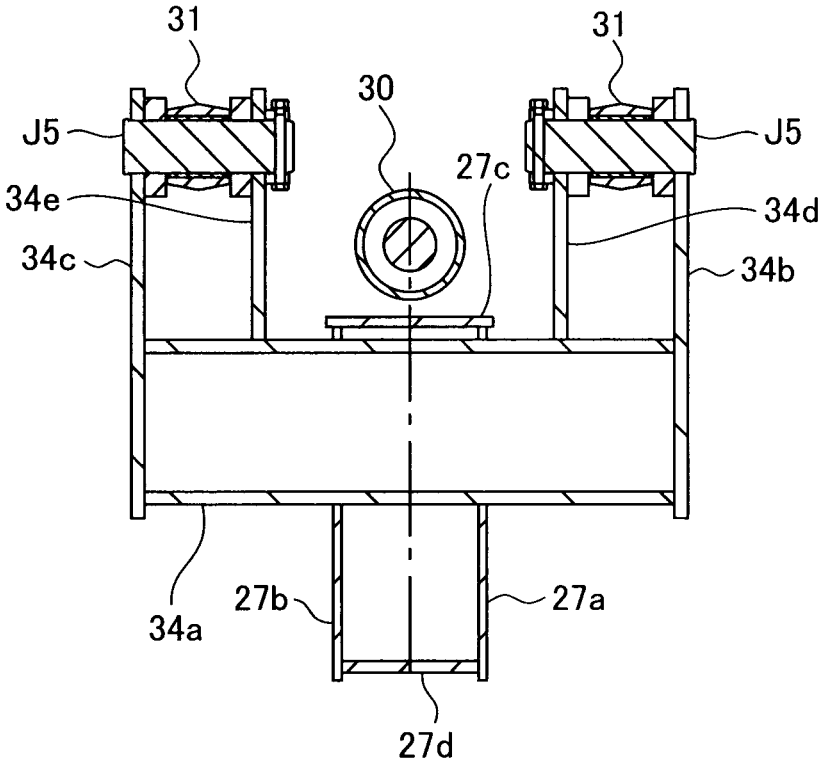
FIG. 6 is an enlarged sectional view taken along the line VI-VI in FIG. 5.

Second Embodiment (See FIGS. 4 through 6)

In this section, the second embodiment of the invention is described. Elements of the second embodiment substantially equivalent or identical to those of the first embodiment are indicated with the same reference numerals as the first embodiment, and description thereof is omitted herein.

The arrangement of the second embodiment is different from the arrangement of the first embodiment in the manner of mounting arm cylinders 31, 31 with respect to an internal boom 26 and an arm 27. Specifically, in the second embodiment, the attachment point B of the arm cylinders 31, 31 with respect to the internal boom 26 is set at the same position as the connection point of a boom 25 with respect to the internal boom 26. In other words, an arm cylinder head pin J6 which defines the attachment point B is also used as a boom head pin.

Further, ends of the arm cylinders 31, 31 opposite to the arm cylinder head pin J6 are attached to the arm 27 via a second arm cylinder attachment portion 34. Specifically, as shown in FIG. 6, the arm 27 includes a body portion comprised of a right side plate 27*a*, a left side plate 27*b*, a bottom plate 27*c*, and a top plate 27*d*; and the second arm cylinder attachment portion 34 for mounting the arm cylinders 31 and 31.

The second arm cylinder attachment portion 34 supports the arm cylinders 31, 31 at a different position from the internal boom cylinder 30 in the width direction of the working attachment 24. Specifically, the second arm cylinder attachment portion 34 includes a tubular member 34*a* which passes through the side plates 27*a* and 27*b* and which extends transversely from the side plates 27*a* and 27*b*; brackets 34*b* and 34*c* respectively fixed to both end surfaces of the tubular member 34*a*; a bracket 34*d* disposed between the side plate 27*a* and the bracket 34*b*; and a bracket 34*e* disposed between the side plate 27*b* and the bracket 34*c*. The brackets 34*b* through 34*e* respectively extend from the tubular member 34*a* toward the attachment inner position (upwardly) in the transport posture. The brackets 34*b*, 34*d* rotatably support an end portion of the arm cylinders 31, 31 disposed between the brackets 34*b*, 34*d* about a horizontal axis J5. The brackets 34*c*, 34*e* rotatably support an end portion of the arm cylinder 31 disposed between the brackets 34*c*, 34*e* about another horizontal axis J5. The respective horizontal axes J5 are located above the internal boom cylinder 30 in the transport posture. Specifically, in this embodiment, the internal boom cylinder 30, and the arm cylinders 31, 31 do not intersect with each other, and are disposed vertically away from each other in side view of the working attachment 24; and the respective brackets 34*b* through 34*e* intersect with the internal boom cylinder 30.

With the provision of the second arm cylinder attachment portion 34, the attachment positions of the arm cylinders 31, 31 are set to a position closer to the boom 25 in the transport posture, namely, set at a high position. Accordingly, in this embodiment, a longer moment length β2 is secured.

The arrangement of this embodiment is advantageous in further reducing a required length for the internal boom 26, and further reducing the height of the working attachment 24 in the transport posture.

Further, use of the arm cylinder head pin J6 as a boom head pin enables to reduce the number of parts, simplify the construction, and reduce the production cost.

In this embodiment, described is an example, wherein the attachment point B of the arm cylinders 31, 31 with respect to the internal boom 26, and the connection point of the boom 25 with respect to the internal boom 26 are set at the same position. The invention is not limited to the above arrangement. Alternatively, the attachment point A of the internal boom cylinder 30 with respect to the internal boom 26, and the connection point of the arm 27 with respect to the internal boom 26 may be set at the same position, in place of or in addition to the arrangement of the embodiment.

Figure 7:
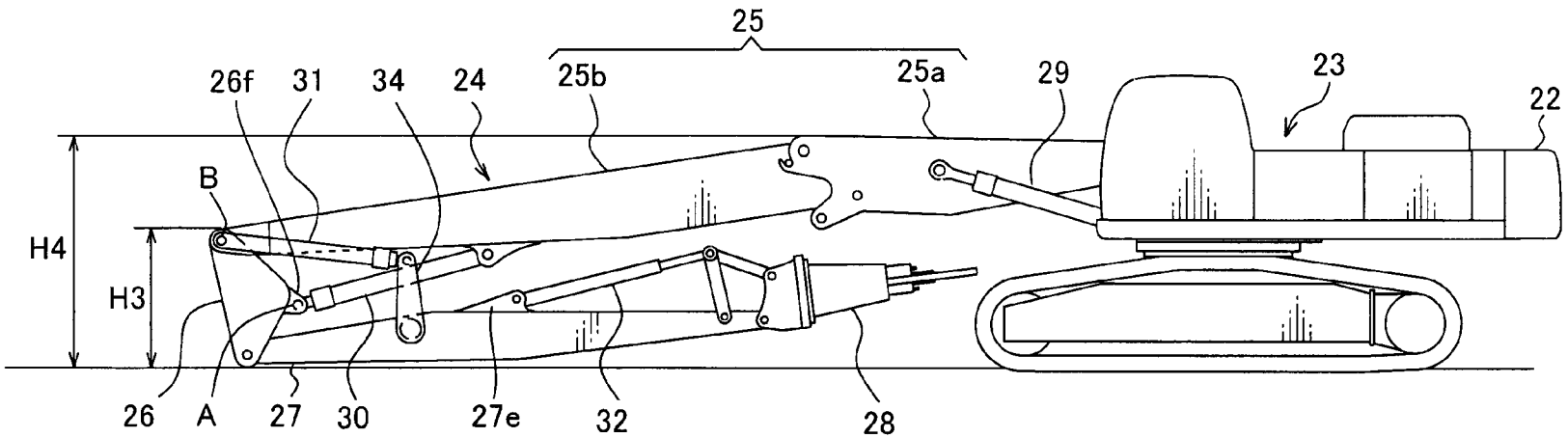
FIG. 7 is a diagram corresponding to FIG. 1 and showing the third embodiment of the invention.

Third Embodiment (See FIG. 7)

In this section, the third embodiment of the invention is described. Elements of the third embodiment substantially equivalent or identical to those of the first or the second embodiment are indicated with the same reference numerals as the first or the second embodiment, and description thereof is omitted herein.

The arrangement of the third embodiment is different from the arrangements of the first and the second embodiments in a point that a working device cylinder 32 is mounted on the upper surface side of an arm 27 in a transport posture.

Specifically, in this embodiment, the arm 27 has an attachment portion 27*e* extending upright from the bottom plate 27*c* (see FIG. 6). The attachment portion 27*e* extends toward the interior of a working attachment 24 in the transport posture. A head-side end portion of the working device cylinder 32 is rotatably supported by the attachment portion 27*e* about a horizontal axis.

With the above arrangement, there is no need of disposing the working device cylinder 32, an attachment portion thereof, and a pipe arrangement on the lower surface side (side of the top plate 27*d*) of the arm 27 in the transport posture. In this embodiment, since the arm 27 can be directly placed on the ground, the heights H3 and H4 of the working attachment 24 (demolition machine) can be further reduced.

In the first through the third embodiments, one arm cylinder 31 may be disposed at a middle position in the width direction of the working attachment 24, and two internal boom cylinders 30 may be disposed on both sides of the one arm cylinder 31, with the one arm cylinder 31 being interposed between the two internal boom cylinders 30.

Further, the invention is not limited to the arrangement of providing two cylinders for at least one of the internal boom cylinder 30 and the arm cylinder 31. Specifically, one cylinder may be provided for each one of the cylinders 30 and 31 at a different position in the width direction of the working attachment 24.

Figure 8:
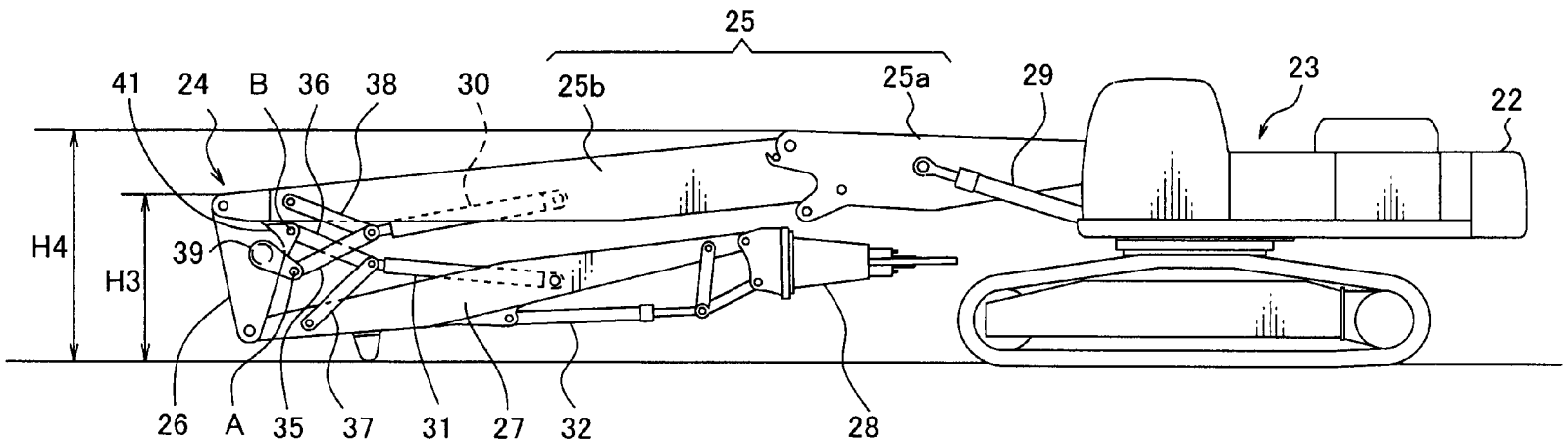
FIG. 8 is a diagram corresponding to FIG. 1 and showing the fourth embodiment of the invention.
Figure 9:
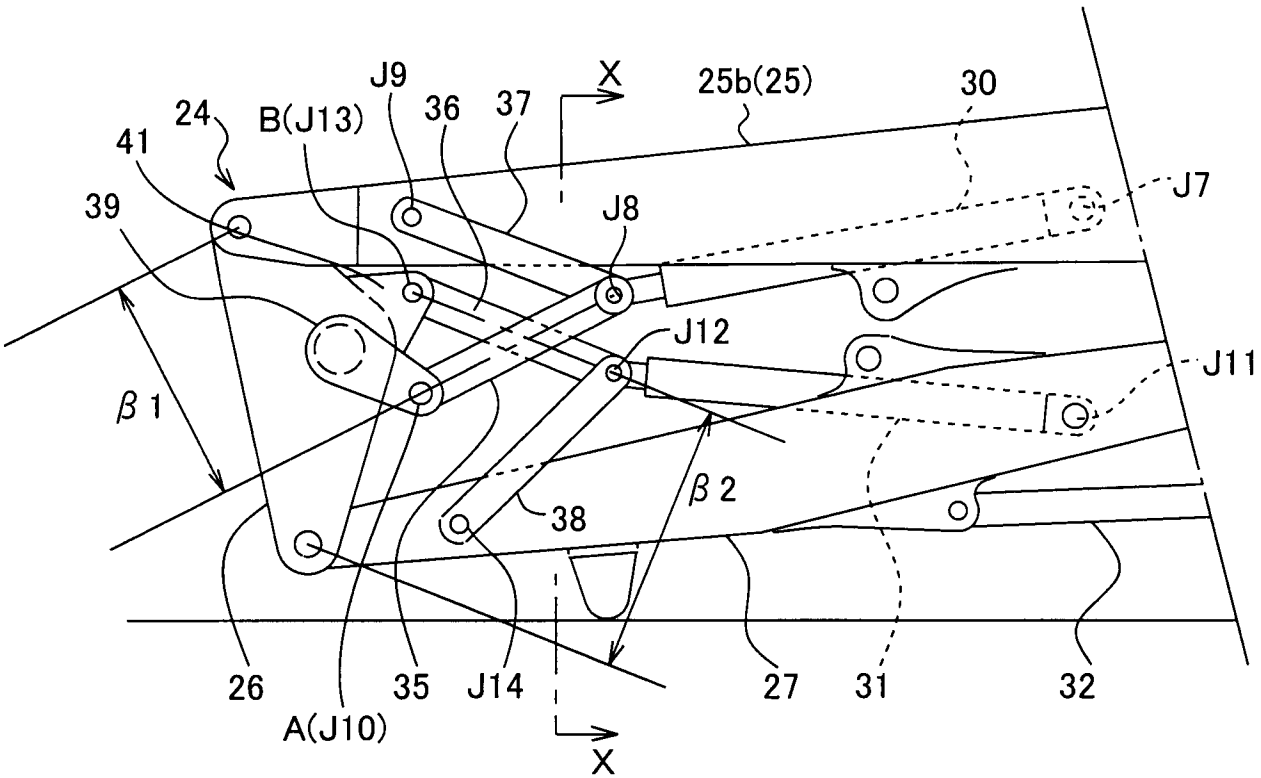
FIG. 9 is a partially enlarged view of FIG. 8.
Figure 10:
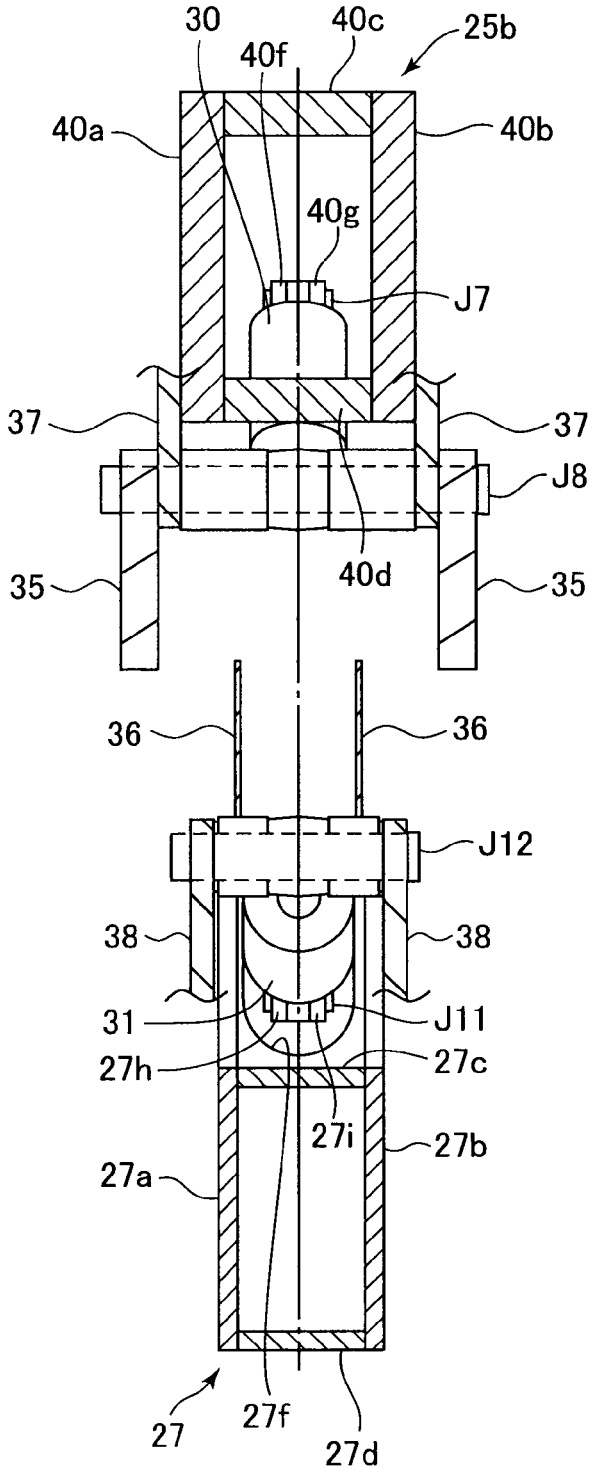
FIG. 10 is an enlarged sectional view taken along the line X-X in FIG. 9.

Fourth Embodiment (See FIGS. 8 through 10)

In this section, the fourth embodiment of the invention is described. Elements of the fourth embodiment substantially equivalent or identical to those of the first through the third embodiments are indicated with the same reference numerals as the first through the third embodiments, and description thereof is omitted herein.

In the fourth embodiment, one cylinder is provided for each one of an internal boom cylinder 30 and an arm cylinder 31 at the same position in the width direction of a working attachment 24. Further, in the fourth embodiment, a pair of link members 35, 35 are disposed between the internal boom cylinder 30 and an internal boom 26; and a pair of link members 36, 36 are disposed between the arm cylinder 31 and the internal boom 26. Further, the link members 35, 35, 36, 36 are displaced from each other in the width direction of the working attachment 24, and are mounted while intersecting with each other in an X-shape in side view of the working attachment 24. In the following, the arrangement is described in detail.

A front boom 25*b* in the embodiment has a housing chamber for housing a part of the internal boom cylinder 30. Specifically, as shown in FIG. 10, the front boom 25*b* is a hollow box-shaped member comprised of a right side plate 40*a*, a left side plate 40*b*, a top plate 40*c*, and a bottom plate 40*d*. Further, the front boom 25*b* has a pair of left and right brackets (second lead-end boom cylinder attachment portion) 40*f*, 40*g* which extend upright from the top plate 40*c* and which are adapted to pivotally support the internal boom cylinder 30. A head-side end portion of the internal boom cylinder 30 is housed in the front boom 25*b* through an unillustrated through-hole formed in the top plate 40*d*. The brackets 40*f*, 40*g* rotatably support the internal boom cylinder 30 disposed between the brackets 40*f*, 40*g* about a horizontal axis J7.

Further, an arm 27 in the embodiment has a housing chamber for housing a part of the arm cylinder 31. Specifically, as shown in FIG. 10, the arm 27 is a hollow box-shaped member comprised of a right side plate 27*a*, a left side plate 27*b*, a bottom plate 27*c*, and a top plate 27*d*. Further, the arm 27 has a pair of left and right brackets (second arm cylinder attachment portion) 27*h*, 27*i* which extend upright from the top plate 27*d* and which are adapted to pivotally support a head-side end portion of the arm cylinder 31. The brackets 27*h*, 27*i* are disposed at the same positions as the brackets 40*f*, 40*g* in the width direction of the working attachment 24. The head-side end portion of the arm cylinder 31 is housed in the arm 27 through a through-hole 27*f* formed in the bottom plate 27*c*. The brackets 27*h*, 27*i* rotatably support the arm cylinder 31 disposed between the brackets 27*h*, 27*i* about a horizontal axis J11.

The link members 35, 35 are rotatably supported by a rod-side end portion of the internal boom cylinder 30 about a horizontal axis J8. Specifically, the link members 35, 35 are disposed on both sides of the internal boom cylinder 30 in the width direction of the working attachment 24, with the internal boom cylinder 30 being interposed between the link members 35, 35.

The link members 36, 36 are rotatably supported by a rod-side end portion of the arm cylinder 31 about a horizontal axis J12. Specifically, the link members 36, 36 are disposed on both sides of the arm cylinder 31 in the width direction of the working attachment 24, with the arm cylinder 31 being interposed between the link members 36, 36, and on the inner side of the link members 35, 35.

The internal boom 26 in this embodiment includes a pair of left and right brackets (first lead-end boom cylinder attachment portion) 39, 39 on which the respective link members 35, 35 are mounted, and a pair of left and right brackets (first arm cylinder attachment portion) 41, 41 on which the respective link members 36, 36 are mounted (in FIGS. 8 and 9, each one of the brackets 39 and 41 are shown).

The brackets 39, 39 rotatably support the lead ends of the link members 35, 35 about a horizontal axis J10, respectively. One of the brackets 39, 39 is disposed on the right side of the right side plate 26*a* (see FIG. 3) of the internal boom 26, and the other one of the brackets 39, 39 is disposed on the left side of the left-side plate 26*b* (see FIG. 3) of the internal boom 26.

The brackets 41, 41 rotatably support the lead ends of the link members 36, 36 about a horizontal axis J13, respectively. The brackets 41, 41 extend upright from the bottom plate 26*c* (see FIG. 3) of the internal boom 26, respectively, so that the brackets 41, 41 are located on the inner side of the brackets 39, 39, respectively. Further, in the transport posture, the positions of the attachment point (horizontal axis J13) between the brackets 41, 41 and the link members 36, 36 are set lower than the positions of the attachment point (horizontal axis J10) between the brackets 39, 39, and the link members 35, 35. With this arrangement, the link members 35, 35 and the link members 36, 36 are disposed at different positions from each other in the width direction of the working attachment 24, and intersect with each other in an X-shape in side view of the working attachment 24.

Further, the demolition machine of this embodiment includes a pair of left and right auxiliary link members 37, 37 for conveying a thrust force of the internal boom cylinder 30 to the internal boom 26, while supporting the link members 35, 35; and a pair of left and right auxiliary link members 38, 38 for conveying a thrust force of the arm cylinder 31 to the arm 27 while supporting the link members 36, 36. Specifically, the auxiliary link members 37, 37 are mounted between the internal boom cylinder 30 and the front boom 25*b* in such a manner as to form a V-shape with the link members 35, 35 in side view of the working attachment 24. Further, the auxiliary link members 38, 38 are mounted between the arm cylinder 31 and the internal boom 26 in such a manner as to form a V-shape with the link members 36, 36 in side view of the working attachment 24.

With the above arrangement, the heights H3 and H4 in a transport posture can be set low, as compared with the conventional art. Further, in the arrangement of the embodiment, one cylinder is provided for each one of the cylinders 30 and 31 at the same position in the width direction of the working attachment 24, in other words, the cylinders 30 and 31 can be disposed on an inner side of the internal boom 26 in the width direction. Accordingly, as compared with an arrangement that two cylinders are provided for one of the cylinders 30 and 31, and the two cylinders are disposed to project outwardly from the internal boom 26 in the widthwise direction, the above arrangement enables to reduce a likelihood that the cylinders 30 and 31 may be damaged resulting from a contact with scrap pieces or the like, and to reduce the production cost because a less number of cylinders is required.

Further, since large portions of the cylinders 30 and 31 are housed in the front boom 25*b* or in the arm 27, the space for the cylinders 30 and 31 can be further reduced, which is advantageous in further reducing the height of the working attachment.

The invention is not limited to a demolition machine, and may also be applied to a working machine designed to attach a lifting magnet or a bucket at a lead end of the working attachment 24.

The aforementioned embodiments mainly include the invention having the following arrangements.

A working machine according to an aspect of the invention includes a base machine; a working attachment; at least one lead-end boom cylinder which is disposed between the base-end boom and the lead-end boom at an attachment inner position corresponding to an inner side of the working attachment in the transport posture, and which is operable to pivotally move the lead-end boom with respect to the base-end boom; and at least one arm cylinder which is disposed between the lead-end boom and the arm at the attachment inner position, and which is operable to move the arm with respect to the lead-end boom. The working attachment includes a base-end boom which is mounted on the base machine to be movable up and down, a lead-end boom which is mounted on a lead end of the base-end boom to be pivotally movable about a horizontal axis, an arm which is mounted on a lead end of the lead-end boom to be pivotally movable about a horizontal axis, and a working device which is mounted on a lead end of the arm. The working attachment is collapsible into a triple-folded state, with the base-end boom being located on the upper side and the arm being located on the lower side with respect to the lead-end boom, as a posture of the working machine for transport. The lead-end boom includes at least one first lead-end boom cylinder attachment portion for mounting the lead-end boom cylinder, and at least one first arm cylinder attachment portion for mounting the arm cylinder. The first lead-end boom cylinder attachment portion is disposed at a position different from the first arm cylinder attachment portion in a widthwise direction of the working attachment, and lower than the first arm cylinder attachment portion in the transport posture.

With the above arrangement, since the first lead-end boom cylinder attachment portion is disposed at a position different from the first arm cylinder attachment portion in a widthwise direction of the working attachment, and lower than the first arm cylinder attachment portion in the transport posture, it is possible to intersect the member to be disposed between the first lead-end boom cylinder attachment portion and the base-end boom, and the member to be disposed between the first arm cylinder attachment portion and the arm with each other in side view of the working attachment. This enables to reduce the heightwise space for both of the first arm cylinder and the first lead-end boom cylinder, while securing substantially the same moment length as the conventional art.

Since the above arrangement enables to shorten the distance (required length for the lead-end boom) between the base-end boom and the arm in a transport posture, it is possible to lower the height (lead-end height and overall height) of the working attachment. This is advantageous in enhancing safety and operability of disassembling/assembling operation.

Further, since the overall height of the working attachment at the time of transport can be lowered, transport by a truck, which was impossible in the conventional art, can be performed. This enables to realize cost reduction. Furthermore, since the centroid of the working attachment is lowered by a lowered overall height of the working attachment at the time of transport, safety at the time of transport is enhanced.

In the working machine, preferably, the lead-end boom cylinder and the arm cylinder may be disposed at such positions that the lead-end boom cylinder and the arm cylinder intersect with each other in an X-shape in side view of the working attachment.

As described above, since the lead-end boom cylinder and the arm cylinder intersect with each other in side view of the working attachment, the above arrangement enables to reduce the heightwise space for both of the lead-end boom cylinder and the arm cylinder, as compared with an arrangement of disposing the lead-end boom cylinder and the arm cylinder at such positions that the lead-end boom cylinder and the arm cylinder do not intersect with each other in side view of the working attachment.

In the working machine, preferably, one cylinder may be provided for one of the lead-end boom cylinder and the arm cylinder, the one cylinder being disposed at a middle position in the width direction of the working attachment, and two cylinders may be provided for the other one of the lead-end boom cylinder and the arm cylinder, the two cylinders being disposed at both sides of the one cylinder in the width direction of the working attachment, with the one cylinder being interposed between the two cylinders.

As described above, since one cylinder is disposed at a middle position in the width direction of the working attachment, and two cylinders are disposed at both sides of the one cylinder in the width direction of the working attachment, with the one cylinder being interposed between the two cylinders, it is possible to uniformly convey a force from the respective cylinders to the lead-end boom and to the arm in the width direction of the working attachment.

In the working machine, preferably, an attachment point which is defined by the first lead-end boom cylinder attachment portion and which is adapted to mount the lead-end boom cylinder may be set at the same position as a connection point between the lead-end boom and the arm in side view of the working attachment.

As described above, since the attachment point for the lead-end boom cylinder, and the connection point between the lead-end boom and the arm are set at the same position, it is possible to effectively use the overall length of the lead-end boom, as the moment length (see $\alpha$1 and $\alpha$2 in FIG. 12). Thus, shortening the required length for the lead-end boom is advantageous in further reducing the heightwise space for the cylinder, and lowering the height of the working attachment.

Further, commonly using the attachment pin for mounting the lead-end boom and the arm, and the attachment pin for mounting the lead-end boom cylinder on the first lead-end boom cylinder attachment portion is advantageous in reducing the number of parts, simplifying the structure, and realizing cost reduction.

In the working machine, preferably, an attachment point which is defined by the first arm cylinder attachment portion and which is adapted to mount the arm cylinder may be set at the same position as a connection point between the lead-end boom and the base-end boom in side view of the working attachment.

As described above, since the attachment point for the arm cylinder, and the connection point between the lead-end boom and the base-end boom are set at the same position, it is possible to effectively use the overall length of the lead-end boom as the moment length. Thus, shortening the required length for the lead-end boom is advantageous in further reducing the heightwise space for the cylinder, and lowering the height of the working attachment.

Further, commonly using the attachment pin for mounting the lead-end boom and the base-end boom, and the attachment pin for mounting the arm cylinder on the first arm cylinder attachment portion is advantageous in reducing the number of parts, simplifying the structure, and realizing cost reduction.

In the working machine, preferably, the base-end boom may include at least one second lead-end boom cylinder attachment portion which is disposed at the same position as the first lead-end boom cylinder attachment portion in the width direction of the working attachment, and which is adapted to mount the lead-end boom cylinder, and the arm may include at least one second arm cylinder attachment portion which is disposed at the same position as the first arm cylinder attachment portion in the width direction of the working attachment, and which is adapted to mount the arm cylinder.

As described above, since both of the first and the second lead-end boom cylinder attachment portions are disposed at the same position in the width direction of the working attachment, and both of the first and the second arm cylinder attachment portions are disposed at the same position in the width direction of the working attachment, it is possible to intersect the lead-end boom cylinder mounted between the first and the second lead-end boom cylinder attachment portions, and the arm cylinder mounted between the first and the second arm cylinder attachment portions in an X-shape in side view of the working attachment. Thus, the above arrangement enables to reduce the heightwise space for both of the lead-end boom cylinder and the arm cylinder, as compared with an arrangement of disposing both of the lead-end boom cylinder and the arm cylinder at such positions that the lead-end boom cylinder and the arm cylinder do not intersect with each other in side view of the working attachment.

In the working machine, preferably, one attachment portion may be provided for one of the first lead-end boom cylinder attachment portion and the first arm cylinder attachment portion, the one attachment portion may be disposed at a middle position in the width direction of the working attachment, and two attachment portions may be provided for the other one of the first lead-end boom cylinder attachment portion and the first arm cylinder attachment portion, the two attachment portion may be disposed at both sides of the one attachment portion in the width direction of the working attachment, with the one attachment portion being interposed between the two attachment portions.

As described above, since one attachment portion is disposed at a middle position in the width direction of the working attachment, and two attachment portions are disposed at both sides of the one attachment portion in the width direction of the working attachment, with the one attachment portion being interposed between the two attachment portions, it is possible to uniformly convey a force from the respective cylinders mounted on the attachment portions to the lead-end boom in the width direction of the working attachment.

Preferably, the working machine may further include a first link member which is disposed between the lead-end boom cylinder and the first lead-end boom cylinder attachment portion, and a second link member which is disposed between the arm cylinder and the first arm cylinder attachment portion, wherein the first link member and the second link member are disposed at such positions that the first link member and the second link member are displaced from each other in the width direction of the working attachment, and intersect with each other in side view of the working attachment.

As described above, since the first link member and the second link member are respectively mounted on the lead-end boom cylinder and on the arm cylinder, and the first link member and the second link member intersect with each other in the width direction of the working attachment, it is possible to reduce the heightwise space for both of the lead-end boom cylinder and the arm cylinder, without positional displacement in the width direction of the working attachment. Further, in the case where the lead-end boom cylinder and the arm cylinder are respectively disposed at the middle position in the width direction of the working attachment, the cylinders are less likely to be damaged resulting from a contact with scrap pieces or the like, as compared with an arrangement of disposing one or both of the cylinders to project outwardly in the width direction of the working attachment. Further, the above arrangement is advantageous in uniformly conveying a force to the lead-end boom, while reducing the number of cylinders, as compared with the aforementioned arrangement of providing one cylinder for one of the lead-end boom cylinder and the arm cylinder at the middle position in the width direction of the working attachment, and providing two cylinders for the other one of the lead-end boom cylinder and the arm cylinder, with the one cylinder being interposed between the two cylinders in the width direction of the working attachment. Thus, the above arrangement enables to reduce the production cost.

In the working machine, preferably, the base-end boom may include a second lead-end boom cylinder attachment portion for mounting the lead-end boom cylinder, the arm may include a second arm cylinder attachment portion which is disposed at the same position as the second lead-end boom cylinder attachment portion in the width direction of the working attachment, and which is adapted to mount the arm cylinder, and the first link member and the second link member may be mounted on the lead-end boom cylinder and the arm cylinder in such a manner that positions of the first link member and the second link member are different from each other in the width direction of the working attachment.

As described above, since the second lead-end boom cylinder attachment portion and the second arm cylinder attachment portion are disposed at the same position in the width direction of the working attachment, and are disposed at different positions from each other in the width direction of the first link member and the second link member, it is possible to reduce the heightwise space for both of the second lead-end boom cylinder and the second arm cylinder, without positional displacement of both of the second lead-end boom cylinder and the second arm cylinder in the width direction of the working attachment.

In the working machine, preferably, the base-end boom may include a hollow member formed with a first housing chamber therein, and the lead-end boom cylinder may be mounted on the base-end boom in a state that a part of the lead-end boom cylinder is housed in the first housing chamber of the base-end boom.

As described above, since a part of the lead-end boom cylinder is housed in the first housing chamber of the base-end boom, it is possible to place the base-end boom and the lead-end boom cylinder one over the other in side view of the working attachment. This is advantageous in further reducing the space for the lead-end boom cylinder, and further reducing the height of the working attachment. In particular, although the distance between the connection position between the lead-end boom cylinder and the base-end boom, and the first lead-end boom cylinder attachment portion is increased by the size of the first link member, since a part of the lead-end boom cylinder is housed in the first housing chamber as described above, it is possible to suppress an increase in the height of the working attachment resulting from the increase of the distance.

In the working machine, preferably, the arm may include a hollow member formed with a second housing chamber therein, and the arm cylinder may be mounted on the arm in a state that a part of the arm cylinder is housed in the second housing chamber of the arm.

As described above, since a part of the arm cylinder is housed in the second housing chamber of the arm, it is possible to place the arm and the arm cylinder one over the other in side view of the working attachment. This is advantageous in further reducing the space for the arm cylinder, and further reducing the height of the working attachment. In particular, although the distance between the connection position between the arm cylinder and the arm, and the first arm cylinder attachment portion is increased by the size of the second link member, since a part of the arm cylinder is housed in the second housing chamber as described above, it is possible to suppress an increase in the height of the working attachment resulting from the increase of the distance.

This application is based on Japanese Patent Application No. 2010-020145 filed on Feb. 1, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A working machine, comprising:

a base machine;

a working attachment including a base-end boom which is mounted on the base machine to be movable up and down, a lead-end boom which is mounted on a lead end of the base-end boom to be pivotally movable about a horizontal axis, an arm which is mounted on a lead end of the lead-end boom to be pivotally movable about a horizontal axis, and a working device which is mounted on a lead end of the arm, the working attachment being collapsible into a triple-folded state, with the base-end boom being located on the upper side and the arm being located on the lower side with respect to the lead-end boom, as a posture of the working machine for transport;

at least one lead-end boom cylinder which is disposed between the base-end boom and the lead-end boom at an attachment inner position corresponding to an inner side of the working attachment in the transport posture, and which is operable to pivotally move the lead-end boom with respect to the base-end boom; and at least one arm cylinder which is disposed between the lead-end boom and the arm at the attachment inner position, and which is operable to move the arm with respect to the lead-end boom, wherein the lead-end boom includes at least one first lead-end boom cylinder attachment portion for mounting the lead-end boom cylinder, and at least one first arm cylinder attachment portion for mounting the arm cylinder, the at least one first lead-end boom cylinder attachment portion is disposed at a position different from the at least one first arm cylinder attachment portion in a widthwise direction of the working attachment, and disposed at a position closer than the at least one first arm cylinder attachment portion with respect to the lead end of the lead-end boom in such a manner the at least one first lead-end boom cylinder attachment portion is below the at least one first arm cylinder attachment portion in the transport posture, the lead-end boom cylinder and the arm cylinder are disposed at such positions that the lead-end boom cylinder and the arm cylinder intersect with each other in an X-shape in side view of the working attachment, one cylinder is provided for one of the lead-end boom cylinder and the arm cylinder, the one cylinder being disposed at a middle position in the width direction of the working attachment, and two cylinders are provided for the other one of the lead-end boom cylinder and the arm cylinder, the two cylinders being disposed at both sides of the one cylinder in the width direction of the working attachment, with the one cylinder being interposed between the two cylinders.

2. The working machine according to claim 1, wherein an attachment point which is defined by the first lead-end boom cylinder attachment portion and which is adapted to mount the lead-end boom cylinder is set at the same position as a connection point for connecting the lead-end boom to the arm in side view of the working attachment.

3. The working machine according to claim 1, wherein an attachment point which is defined by the first arm cylinder attachment portion and which is adapted to mount the arm cylinder is set at the same position as a connection point for connecting the lead-end boom to the base-end boom in side view of the working attachment.

4. The working machine according to claim 1, wherein the base-end boom includes at least one second lead-end boom cylinder attachment portion which is disposed at the same position as the first lead-end boom cylinder attachment portion in the width direction of the working attachment, and which is adapted to mount the lead-end boom cylinder, and the arm includes at least one second arm cylinder attachment portion which is disposed at the same position as the first arm cylinder attachment portion in the width direction of the working attachment, and which is adapted to mount the arm cylinder.

5. The working machine according to claim 4, wherein one attachment portion is provided for one of the first lead-end boom cylinder attachment portion and the first arm cylinder attachment portion, the one attachment portion is disposed at a middle position in the width direction of the working attachment, and two attachment portions are provided for the other one of the first lead-end boom cylinder attachment portion and the first arm cylinder attachment portion, the two attachment portion are disposed at both sides of the one attachment portion in the width direction of the working attachment, with the one attachment portion being interposed between the two attachment portions.

6. The working machine according to claim 1, further comprising a first link member which is disposed between the lead-end boom cylinder and the first lead-end boom cylinder attachment portion, and a second link member which is disposed between the arm cylinder and the first arm cylinder attachment portion, wherein the first link member and the second link member are disposed at such positions that the first link member and the second link member are displaced from each other in the width direction of the working attachment, and intersect with each other in side view of the working attachment.

7. The working machine according to claim 6, wherein the base-end boom includes a second lead-end boom cylinder attachment portion for mounting the lead-end boom cylinder, the arm includes a second arm cylinder attachment portion which is disposed at the same position as the second lead-end boom cylinder attachment portion in the width direction of the working attachment, and which is adapted to mount the arm cylinder, and the first link member and the second link member are mounted on the lead-end boom cylinder and the arm cylinder in such a manner that positions of the first link member and the second link member are different from each other in the width direction of the working attachment.

8. The working machine according to claim 6, wherein the base-end boom includes a hollow member formed with a first housing chamber therein, and the lead-end boom cylinder is mounted on the base-end boom in a state that a part of the lead-end boom cylinder is housed in the first housing chamber of the base-end boom.

9. The working machine according to claim 6, wherein the arm includes a hollow member formed with a second housing chamber therein, and the arm cylinder is mounted on the arm in a state that a part of the arm cylinder is housed in the second housing chamber of the arm.

* * * * *